US007124739B2

(12) United States Patent
Endoh et al.

(10) Patent No.: US 7,124,739 B2
(45) Date of Patent: Oct. 24, 2006

(54) FUEL PRESSURE ADJUSTING APPARATUS

(75) Inventors: Tadao Endoh, Kuki (JP); Katsumi Arai, Tatebayashi (JP); Masaaki Konishi, Chiryu (JP)

(73) Assignees: Kyosan Denki Co., Ltd., Sashima-gun (JP); Denso Corporation, Kariya (JP)

( * ) Notice: Subject to any disclaimer, the term of this patent is extended or adjusted under 35 U.S.C. 154(b) by 0 days.

(21) Appl. No.: 11/174,619

(22) Filed: Jul. 6, 2005

(65) Prior Publication Data

US 2006/0021600 A1 Feb. 2, 2006

(30) Foreign Application Priority Data

Jul. 28, 2004 (JP) ..... 2004-219565

(51) Int. Cl.
*F02M 69/54* (2006.01)
*F02M 51/00* (2006.01)

(52) U.S. Cl. ..... 123/457; 123/511

(58) Field of Classification Search ..... 123/457, 123/511, 512, 513, 459–466; 137/540, 539
See application file for complete search history.

(56) References Cited

U.S. PATENT DOCUMENTS 5,226,628 A * 7/1993 Daly ..... 251/129.02
5,564,397 A * 10/1996 Kleppner et al. ..... 123/514
5,649,514 A 7/1997 Okada et al.
5,775,894 A * 7/1998 Kosco, Jr. ..... 418/63
6,382,183 B1 * 5/2002 Preston et al. ..... 123/457
6,681,798 B1 * 1/2004 Bueser et al. ..... 137/539
6,782,871 B1 * 8/2004 McIntyre et al. ..... 123/457
2003/0196702 A1 * 10/2003 Bueser et al. ..... 137/535
2004/0149338 A1 * 8/2004 Wheeler et al. ..... 137/539
2004/0177884 A1 9/2004 Konishi

FOREIGN PATENT DOCUMENTS

JP A 2000-045897 2/2000

* cited by examiner

*Primary Examiner*—Mahmoud Gimie
(74) *Attorney, Agent, or Firm*—Oliff & Berridge PLC

(57) ABSTRACT

A fuel pressure adjusting apparatus which includes a casing which includes a fuel introduction port, and a fuel discharge port; and a cylindrical member which is housed in the casing, and which includes a valve seat at an end portion thereof, and a communication passage therein, the communication passage connecting the fuel introduction port to the fuel discharge port; a valve element which is provided on a fuel discharge port-side of the valve element in the casing, and which closes the communication passage when the valve element is seated on the valve seat; and a leaf spring which is provided at the fuel discharge port, and which applies force to the valve element in a direction toward the valve seat. The leaf spring includes a concave portion which supports the valve element, and which is formed such that there is a gap between the concave portion and the valve element.

11 Claims, 8 Drawing Sheets

FUEL PRESSURE ADJUSTING APPARATUS

INCORPORATION BY REFERENCE

The disclosure of Japanese Patent Application No. 2004-219565 filed on Jul. 28, 2004 including the specification, drawings and abstract is incorporated herein by reference in its entirety.

BACKGROUND OF THE INVENTION

1. Field of the Invention

The invention relates to a fuel pressure adjusting apparatus which adjusts a pressure of fuel supplied from a fuel tank to an injector of an internal combustion engine by a fuel pump.

2. Description of the Related Art

Japanese Patent Application Publication No. JP(A) 2000-45897 discloses a fuel pressure adjusting apparatus shown in FIG. 8. In the fuel pressure adjusting apparatus 1, an inside of a casing 2 is divided into an atmosphere chamber 4 and a fuel chamber 5 by a diaphragm 3, and a valve element 6 is provided in the diaphragm 3.

When a pressure of fuel introduced into the fuel chamber 5 through a fuel introduction port 8 becomes equal to or higher than a predetermined value, the diaphragm 3 is moved upward against the force applied by a spring 7, and the valve element 6 opens a fuel discharge port 9. When the valve element 6 opens the fuel discharge port 9, fuel in the fuel chamber 5 is returned to a fuel tank (not shown) through the fuel discharge port 9 as shown by an arrow. As a result, the pressure of the fuel supplied to an injector of an internal combustion engine is adjusted to the predetermined value.

However, in such a fuel pressure adjusting apparatus, the diaphragm needs to be provided so that the two chambers, which are the atmosphere chamber 4 and the fuel chamber 5, are formed. As a result, the number of components is increased, and the entire size of the fuel pressure adjusting apparatus is increased. Also, when the valve element 6 opens the fuel discharge port 9 and the fuel flows out through the fuel discharge port 9, the flow of the fuel is contracted, the pressure of the fuel is reduced, vapor is generated in the fuel pressure adjusting apparatus 1.

In order to solve these problems, a fuel pressure adjusting apparatus shown in each of FIG. 6 and FIG. 7 is proposed.

The fuel pressure adjusting apparatus includes a casing 10; a cylindrical member 11, a valve element 12, and a leaf spring 13 which serves as force-applying means. The casing 10 includes a fuel introduction port 14 and a fuel discharge port 15. The cylindrical member 11 having a communication passage 17 is fixed in the fuel introduction port 14 side of the casing 10. The leaf spring 13 having plural communication ports 18 is joined to the fuel discharge port 15 by crimping. When the cylindrical member 11 and the leaf spring 13 are fixed to the casing 10, the valve element 12 is supported between the cylindrical member 11 and the leaf spring 13 such that one end portion of the valve element 12 contacts a valve seat 16 formed at an end portion of the cylindrical member 11, and the other end portion of the valve element 12 contacts the leaf spring 13.

In the fuel pressure adjusting apparatus with the aforementioned configuration, fuel is supplied to the communication passage 17 of the cylindrical member 11 from a fuel pump (not shown). The fuel constantly applies downward force to the valve element 12. The leaf spring 13 constantly applies upward force to the valve element 12. When the pressure of the fuel is equal to or lower than a predetermined value, the valve element 12 contacts the valve seat 16 of the cylindrical member 11, and closes the communication passage 17 of the cylindrical member 11.

When the pressure of the fuel becomes equal to or higher than the predetermined value, the valve element 12 is moved downward, and the fuel in the communication passage 17 is returned to a fuel tank (not shown) through the communication ports 18 formed in the leaf spring 13. FIG. 6 shows an example of the fuel pressure adjusting apparatus in which the valve element 12 contacts a flat surface of the leaf spring 13. FIG. 7 shows an example of the fuel pressure adjusting apparatus in which the valve element 12 is fitted in a center opening portion 19 formed in the center of the leaf spring 13.

In this fuel pressure adjusting apparatus, the diaphragm and the atmosphere chamber do not need to be provided. Therefore, cost and size of this fuel pressure adjusting apparatus can be reduced, Further, since the fuel flows along the surface of the valve element 12 when the valve element 12 opens the communication passage 17, an amount of generated vapor can be reduced.

However, this fuel pressure adjusting apparatus has disadvantages described below. Since the surface of the leaf spring 13 which the valve element 12 contacts is flat in the fuel pressure adjusting apparatus shown in FIG. 6, when the valve element 12 closes the communication passage 17, an axis of the valve element 12 matches an axis of the valve seat 16 due to a self-aligning effect. Thus, it is possible to prevent the situation in which the valve element 12 contacts the valve seat 16 with the axis of the valve element 12 being deviated from the axis of the valve seat 16, and therefore the fuel leaks.

However, since a distance for which the fuel flows until the fuel hits the leaf spring 13 is the same as the diameter of the valve element 12 when the valve element 12 opens the communication passage 17. Therefore, the flow of the fuel become unstable in the vicinity of a low end of the valve element 12. As a result, the valve element 12 vibrates, and noise occurs.

In the fuel pressure adjusting apparatus shown in FIG. 7, the valve element 12 is fitted in the center opening portion 19 provided in the center of the leaf spring 13, and the valve element 12 is in a fixed state. A distance for which the fuel flows until the fuel hits the leaf spring 13 is smaller than the diameter of the valve element 12. Therefore, before the flow of the fuel becomes unstable in the vicinity of the low end of the valve element 12, the flow of the fuel is separated from the valve element 12. Therefore, the vibration of the valve 12 is reduced.

However, since the valve element 12 is fixed in the center opening portion 19, it is necessary to increase accuracy of production and assembly in order to make the axis of the valve element 12 match the axis of the center opening portion 19 when the valve element 12 closes the communication passage 17. However, it is difficult to increase the accuracy of production and assembly in terms of man power and cost.

Therefore, when the valve element 12 closes the communication passage 17, the axis of the valve element 12 may be slightly deviated form the axis of the center opening portion 19. In this case, the fuel leaks, or a contact portion of the valve element 12 partially wears out. Also, in the case where the axis of the valve element 12 is slightly deviated from the axis of the center opening portion 19, an area of an opening portion on the right side of the valve element 12 becomes different from an area of an opening portion on the left side of the valve element 12 when the valve element 12 opens the communication passage 17. As a result, an amount of the fuel flowing out through the opening portion on the right side of the valve element 12 becomes different from an amount of the fuel flowing out through the opening portion on the left side of the valve element 12. Accordingly, the valve 12 vibrates and abnormal noise occurs when the valve element 12 opens the communication passage 17, as well as in the case of the fuel pressure adjusting apparatus shown in FIG. 6.

Also, in the case where the axis of the valve element 12 is deviated from the axis of the center opening portion 19, when the valve element 12 opens the communication passage 17, the control pressure drops at low flow rates as shown by black triangles and black squares in FIG. 5, that is, the fuel flows out at a pressure equal to or lower than the predetermined value.

SUMMARY OF THE INVENTION

In view of the above, it is an object of the invention to provide a fuel pressure adjusting apparatus in which deviation of an axis of a valve element from an axis of a valve seat is reduced by forming a concave portion for supporting the valve element in a leaf spring which serves as force-applying means such that there is a small gap between the valve element and the concave portion.

A first aspect of the invention relates to a fuel pressure adjusting apparatus. The fuel pressure adjusting apparatus includes a casing which includes a fuel introduction port, and a fuel discharge port; and a cylindrical member which is housed in the casing, and which includes a valve seat at an end portion thereof, and a communication passage therein, the communication passage which connects the fuel introduction port to the fuel discharge port, and in which a fuel flows; a valve element which is provided on a fuel discharge port-side of the cylindrical member in the casing, and which closes the communication passage when the valve element is seated on the valve seat; and a force-applying member which is provided at the fuel discharge port of the casing, and which applies force to the valve element in a direction toward the valve seat. In the fuel pressure adjusting apparatus, the force-applying member includes a concave portion which supports the valve element, which includes a bottom surface and a side wall surface, and which is formed such that there is a gap between the side wall surface and the valve element.

With this configuration, the force-applying member includes the concave portion which supports the valve element, and which is formed such that there is a small gap between the side wall surface of the concave portion and the valve element. Accordingly, even in a case where an axis of the valve element is slightly deviated from an axis of the valve seat, the axis of the valve element is caused to match the axis of the valve seat due to a self-aligning effect. Therefore, it is possible to prevent leakage of the fuel when the valve element closes the communication passage, and to prevent partial wear of the valve element. Also, when the valve element opens the communication passage, the flow of the fuel is separated from the valve element before the flow of the fuel becomes unstable in the vicinity of the low end of the valve element. Therefore, it is possible to prevent occurrence of abnormal noise caused by instability of the valve element, and to prevent a drop in the control pressure at low flow rates.

In the first aspect of the invention, the valve element may be a spherical body.

With the configuration, since the valve element is a spherical body, it is possible to make the structure of the valve element simple and small, and to cause the fuel to flow out smoothly.

In the aspect related to the first aspect of the invention, a depth of the concave portion may be equal to or smaller than a half of a diameter of the valve element.

With the configuration, since the depth of the concave portion is equal to or smaller than a half of the diameter of the valve element, it is possible to easily form the concave portion, and to prevent vibration of the valve element due to the fuel flowing into the concave portion.

In the first aspect of the invention, the force-applying member may be a leaf spring having a flat plate shape, and an outer edge portion of the force-applying member may be fixed to the casing.

With this configuration, since the force-applying member is a leaf spring having a flat plate shape and the outer edge portion of the force-applying member is fixed to the casing, size of the fuel pressure adjusting apparatus can be made small.

In the first aspect of the invention, the force-applying member may include a communication port.

With this configuration, since the communication port is formed in the force-applying member, it is not necessary to provide specific passage means. Therefore, it is possible to reduce the production cost.

In the first aspect of the invention, the force-applying member may be joined to the casing by crimping. Since the force-applying member is joined to the casing by crimping, the force-applying member can be joined to the casing easily. Therefore, it is possible to reduce the production cost.

In the first aspect of the invention, an area of an opening portion of the concave portion may be larger than a cross sectional area of the valve element in the opening portion.

BRIEF DESCRIPTION OF THE DRAWINGS

The foregoing and further objects, features and advantages of the invention will become apparent from the following description of exemplary embodiments with reference to the accompanying drawings, wherein like numerals are used to represent like elements and wherein.

DETAILED DESCRIPTION OF THE EXEMPLARY EMBODIMENTS

Figure 1:
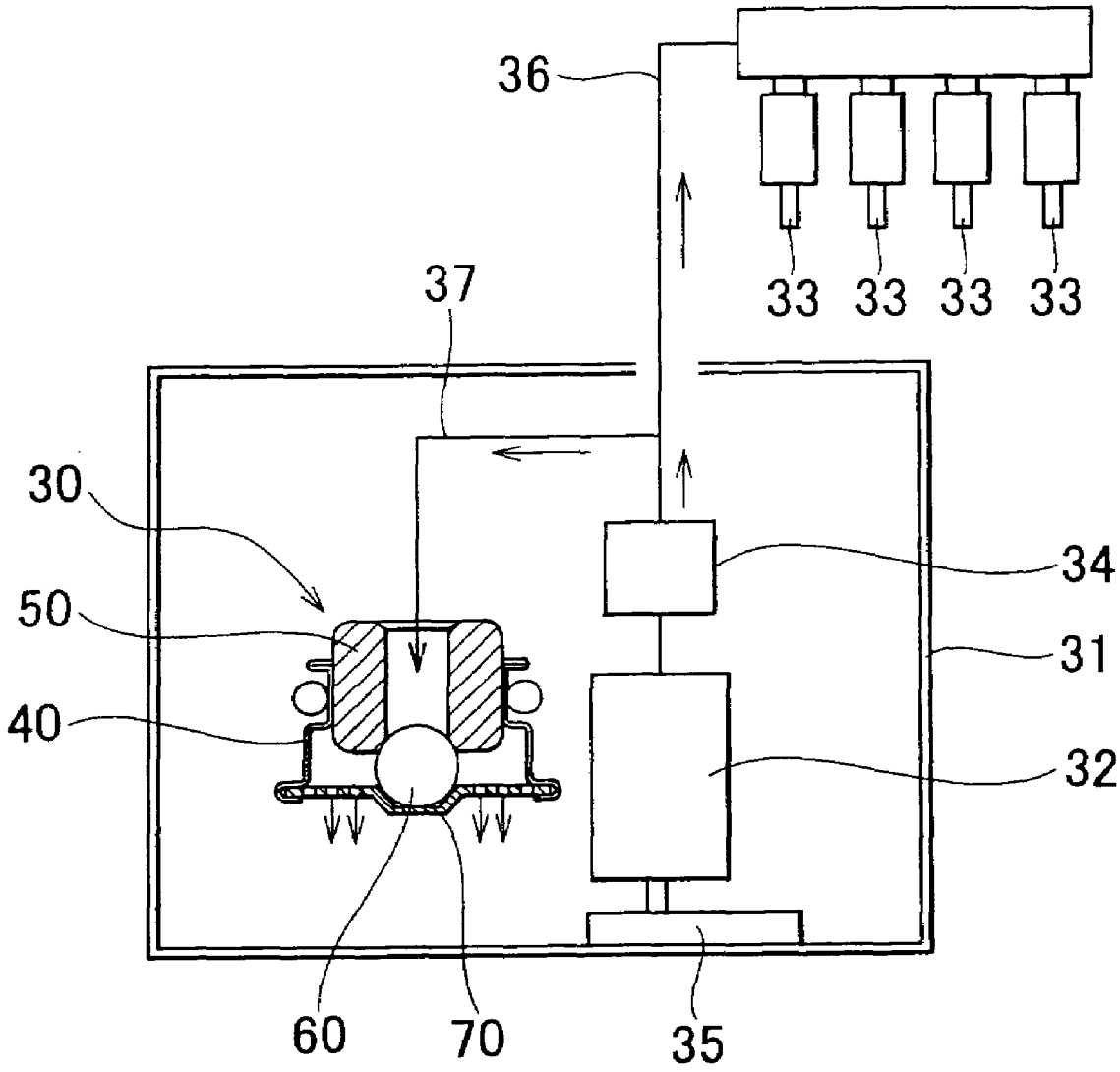
FIG. 1 is a schematic diagram showing an entire fuel pressure adjusting apparatus according to the invention.
Figure 2:
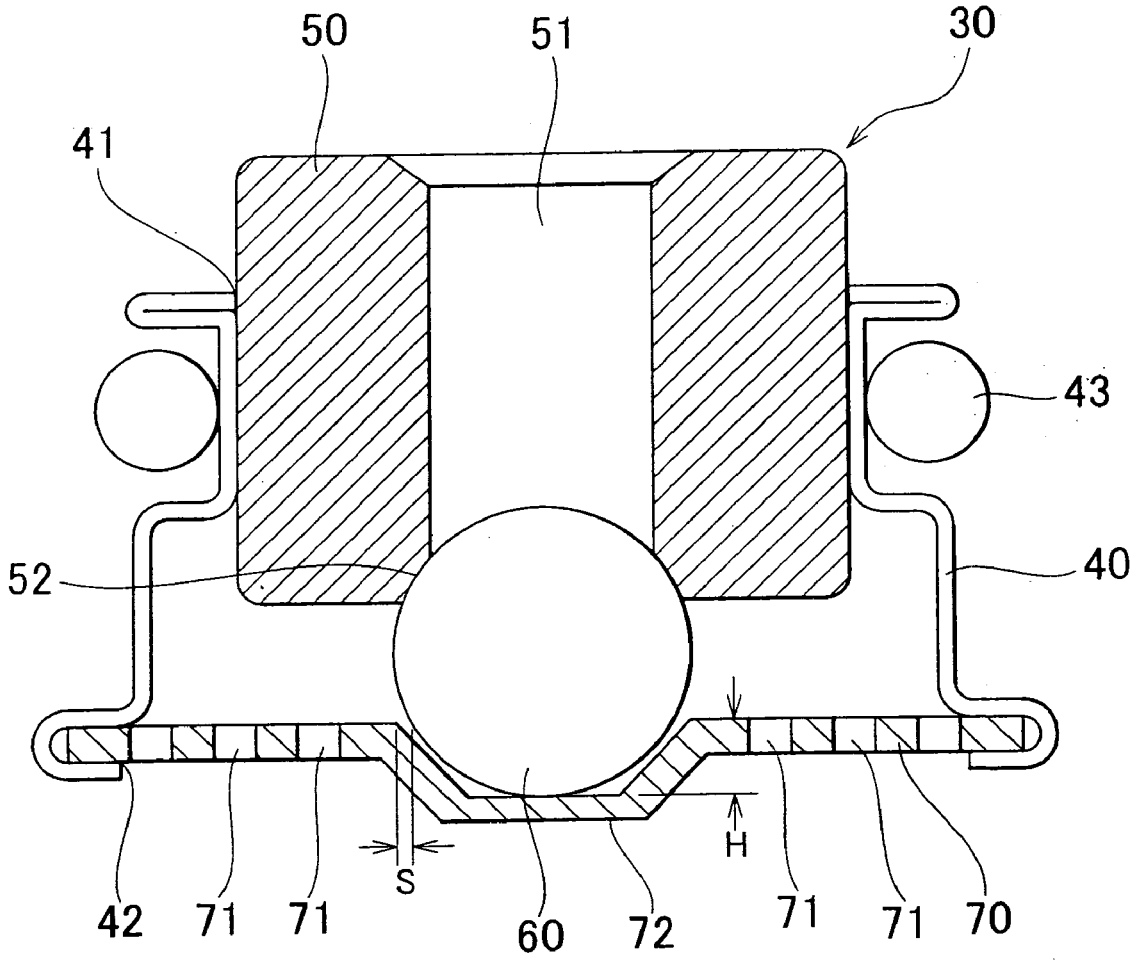
FIG. 2 is a cross sectional view showing the fuel pressure adjusting apparatus according to the invention, in which a valve element closes a communication passage.
Figure 3:
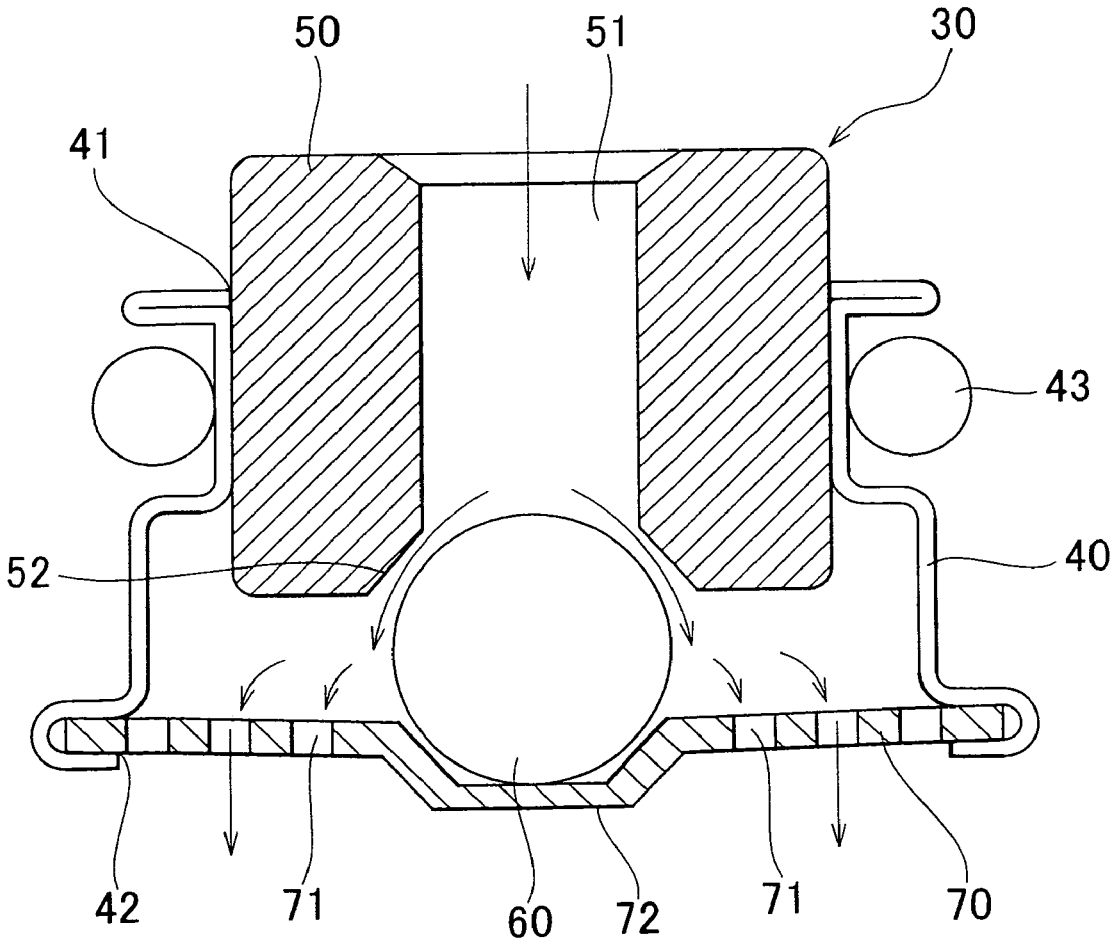
FIG. 3 is a cross sectional view showing the fuel pressure adjusting apparatus according to the invention, in which the valve element opens the communication passage.
Figure 4:
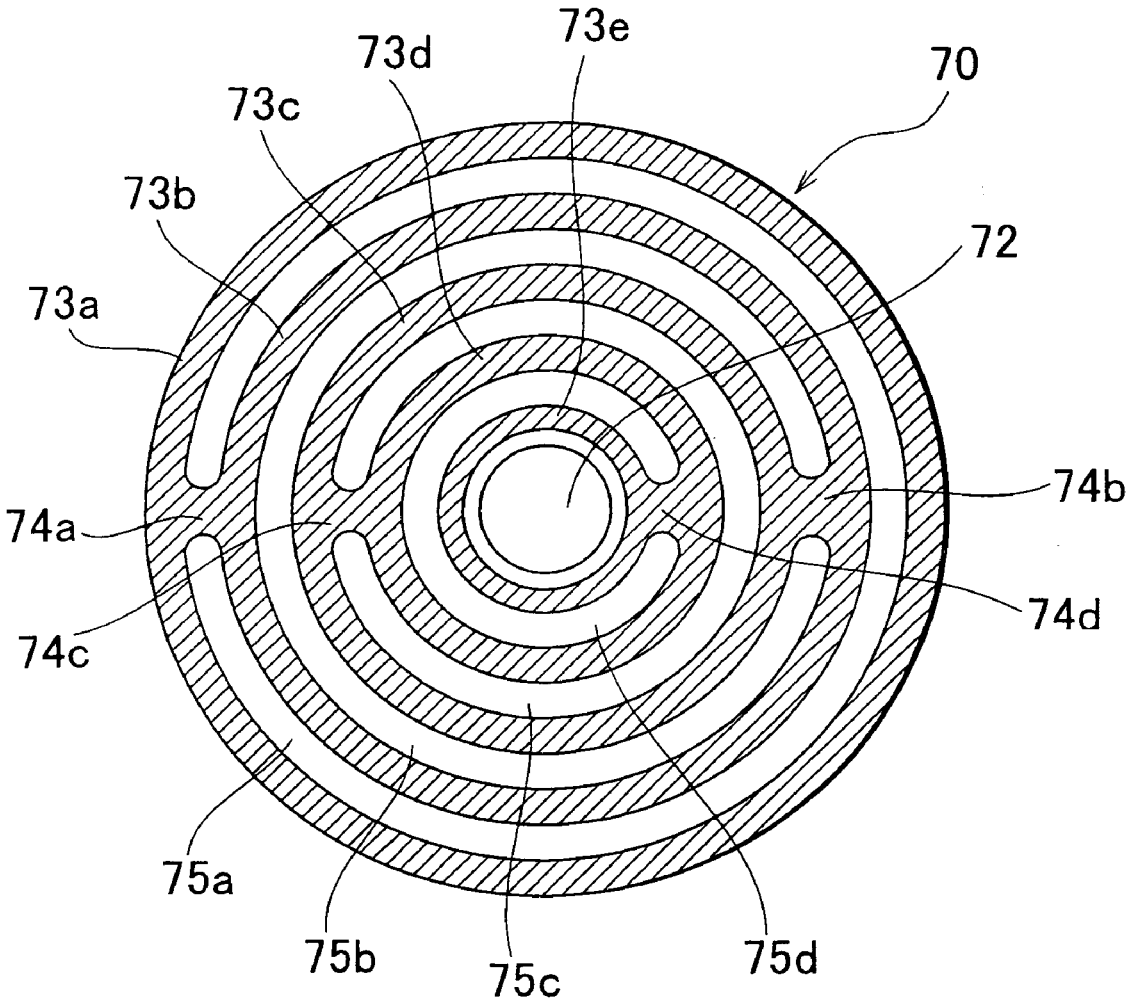
FIG. 4 is a plan view showing a leaf spring of the fuel pressure adjusting apparatus according to the invention.
Figure 5:
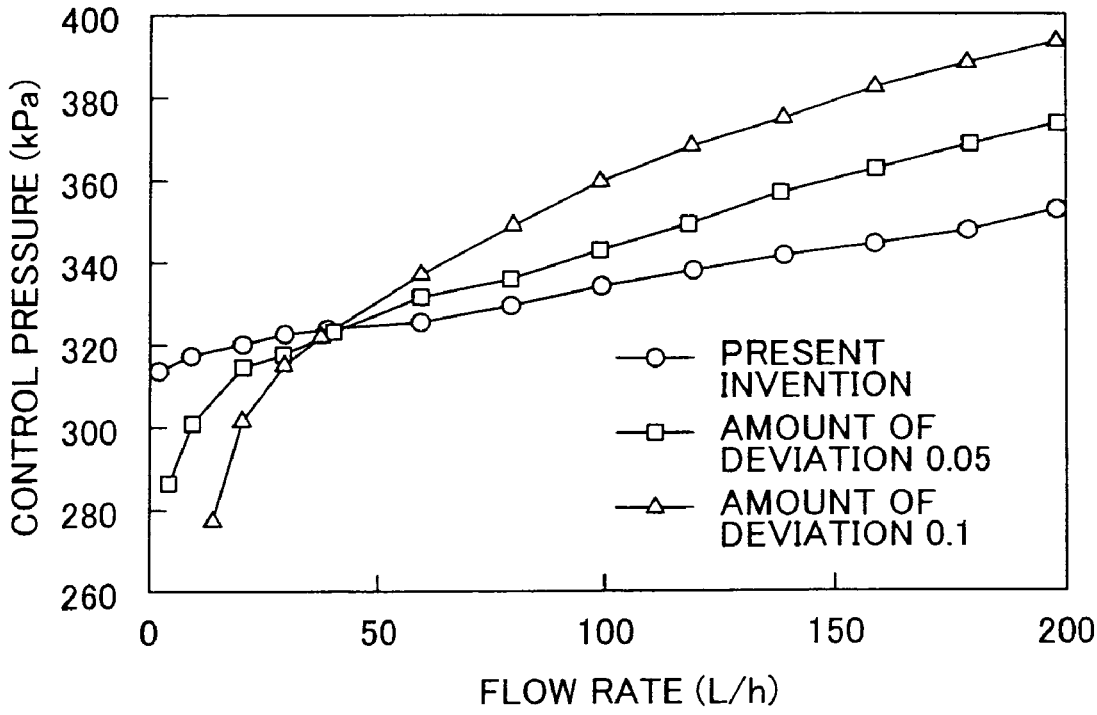
FIG. 5 is a graph showing a fuel flow rate—control pressure characteristic of the fuel pressure adjusting apparatus according to the invention.

FIG. 1 is a schematic diagram showing an entire fuel supply system including a fuel pressure adjusting apparatus. FIG. 2 is a cross sectional view showing the fuel pressure adjusting apparatus in which a valve element closes a communication passage. FIG. 3 is a cross sectional view showing the fuel pressure adjusting apparatus in which the valve element opens the communication passage. FIG. 4 shows a plan view showing a leaf spring. FIG. 5 shows a control pressure characteristic with respect to a flow rate of fuel.

For example, a fuel pressure adjusting apparatus 30 is provided so as to be connected to a fuel passage 36 through which fuel is supplied from a fuel tank 31 of a vehicle to injectors 33 of an internal combustion engine by a fuel pump 32. The fuel pressure adjusting apparatus 30 adjusts a pressure of the fuel supplied to the injectors 33 to a predetermined value. Hereinafter, the in-tank type fuel pressure adjusting apparatus will be described.

In the fuel tank 31, the fuel pump 32, a fuel filter 34, and a suction filter 35 are provided. When the fuel pump 32 is driven, the fuel is sucked by the suction filter 35 provided at a bottom portion of the fuel tank 31. Then, the pressure of the fuel is increased by the fuel pump 32, and the fuel whose pressure has been increased is filtered by the fuel filter 34. Then, the fuel is supplied to the injectors 33 through the fuel passage 36.

In the fuel tank 31, the fuel pressure adjusting apparatus 30 is provided so as to be connected to the fuel passage 36 via a branch passage 37. When the pressure of the fuel in the fuel passage 36 is equal to or higher than a predetermined value, the fuel pressure adjusting apparatus 30 is brought into a valve-open state so that the pressure of the fuel in the fuel passage 36 is maintained at the predetermined value. The fuel pressure adjusting apparatus 30 includes a casing 40, a cylindrical member 50, a valve element 60, and a leaf spring 70 which serves as one example of force-applying means or a force-applying member.

The casing 40 is a member having a cylindrical shape. The casing 40 includes a fuel introduction port 41 at an upper end portion thereof, and a fuel discharge port 42 at a lower end portion thereof. O-rings 43 are provided on a side wall portion immediately below the upper end portion. A pipe which serves as the branch passage 37 is connected to a communication passage 51. The o-rings 43 may be provided on an outer periphery of the cylindrical member 50.

The cylindrical member 50 is a member having a cylindrical shape. The communication passage 51 is formed in a center portion of the cylindrical member 50. The communication passage 51 is connected to the branch passage 37. A valve seat 52 having a ring shape is formed at a lower end portion of the cylindrical member 50. The cylindrical member 50 is pressed into the casing 40 from the upper end portion of the casing 40, and is fixed.

The leaf spring 70 is a spring member having a circular cross section, and having a flat plate shape. FIG. 4 shows a plan view showing the leaf spring 70. The leaf spring 70 includes five ring-shaped portions 73*a*, 73*b*, 73*c*, 73*d*, and 73*e*; and four connection portions 74*a*, 74*b*, 74*c*, and 74*d*. The five ring-shaped portions 73*a*, 73*b*, 73*c*, 73*d*, and 73*e* are concentrically arranged. The four connection portions 74*a*, 74*b*, 74*c*, and 74*d* connect the two ring-shaped portions adjacent to each other. That is, the connection portion 74*a* connects the ring-shaped portions 73*a* and 73*b*. The connection portion 74*b* connects the ring-shaped portions 73*b* and 73*c*. The connection portion 74*c* connects the ring-shaped portions 73*c* and 73*d*. The connection portion 74*d* connects the ring-shaped portions 73*d* and 73*e*. Four C-shaped opening portions 75*a*, 75*b*, 75*c*, and 75*d* are concentrically formed. The opening portion 75*a* is formed between the ring-shaped portions 73*a* and 73*b*. The opening portion 75*b* is formed between the ring-shaped portions 73*b* and 73*c*. The opening portion 75*c* is formed between the ring-shaped portions 73*c* and 73*d*. The opening portion 75*d* is formed between the ring-shaped portions 73*d* and 73*e*. The opening portions 75*a*, 75*b*, 75*c*, and 75*d* are equivalent to communication ports 71.

Also, a concave portion 72 having a depth H is formed in the center ring-shaped portion 73*e*. The ring-shaped portion 73*a* at an outer edge portion of the leaf spring 70 is joined to the lower end portion of the casing 40 by crimping. If the depth H of the concave portion 72 is extremely large, it may be difficult to form the concave portion 72, and a valve element 60 may be caused to vibrate due to the fuel flowing into the concave portion 72. Therefore, it is preferable that the depth H should be equal to or smaller than a half of the diameter of the valve element 60.

Size of an upper open end of the concave portion 72 is set such that a gap S (refer to FIG. 2) between the valve element 60 and the concave portion 72, especially a side wall surface thereof, can allows the valve element 60 to be placed in the concave portion 72 even in the case where the axis of the valve element 60 is deviated from the axis of the valve seat 52. However, if the gap S is extremely large, the valve element 60 becomes unstable, and abnormal noise occurs.

The ring-shaped portion 73*a* of the leaf spring 70 serves as a fixed end, and the concave portion 72 at the center of the leaf spring 70 serves as a free end. Thus, the concave portion 72 moves upward and downward. Since the leaf spring 70 has the aforementioned shape, the concave portion 72 of the leaf spring 70 can be moved in a substantially vertical direction. As a result, the valve 60 can be moved upward and downward in the substantially vertical direction such that the axis of the valve element 60 is not deviated from the axis of the valve seat 52. Instead of the leaf spring 70, a coil spring may be used.

The valve element 60 has a sphere shape. When the leaf spring 70 is joined to the lower end portion of the casing 40 by crimping, the valve 60 is supported between the cylindrical member 50 and the leaf spring 70 such that one end portion of the valve element 60 contacts the valve seat 52 formed at the end portion of the cylindrical member 50, and the other end portion of the valve element 60 contacts a bottom surface of the concave portion 72 of the leaf spring 70.

Next, operation of the fuel pressure adjusting apparatus 30 will be described. The pressure of the fuel is increased by the fuel pump 32, and the fuel whose pressure has been increased is supplied to the injectors 33 of the engine through the fuel passage 36. The pressure of the fuel in the fuel passage 36 acts on an upper portion of the valve element 60 through the communication passage 51 of the cylindrical member 50. The fuel constantly applies downward force to the valve element 60. Meanwhile, the leaf spring 70 constantly applies upward force to the valve element 60. When the pressure of the fuel is equal to or lower than the predetermined value, the valve element 60 contacts the valve seat 52 of the cylindrical member 50 as shown in FIG. 2 so as to close the communication passage 51 of the cylindrical member 50.

Even in the case where the axis of the valve element 60 has been slightly deviated from the axis of the valve seat 52 in a production process and an assembly process, the gap S which is formed at the concave portion 72 allows the valve element 60 to be placed in the concave portion 72. Also, the gap S allows the axis of the valve element 60 to match the axis of the valve seat 52 due to the self-aligning effect when the valve element 60 closes the communication passage 51.

Therefore, it is possible to prevent leakage of the fuel when the valve element closes the communication passage, and to prevent partial wear of the valve element.

When the pressure of the fuel becomes equal to or higher than the predetermined value, the valve element 60 is moved downward as shown in FIG. 3, and communication is provided between the communication passage 51 and the fuel discharge port 42. Therefore, the fuel in the communication passage 51 flows out through the communication ports 71 as shown by an arrow, and thus the fuel in the fuel passage 36 is adjusted to the predetermined value.

In this case, the valve element 60 is moved downward with the axis of the valve element 60 matching the axis of the valve seat 52. Therefore, an amount of the fuel flowing out through an opening portion on the right side of the valve element 60 does not become different from an amount of the fuel flowing out through an opening portion on the left side of the valve element 60. As a result, it is possible to prevent a drop in the control pressure when the flow rate of the fuel is low. Also, a distance for which the fuel flows until the fuel hits the leaf spring 70 is smaller than the diameter of the valve element 60. Therefore, before the flow of the fuel becomes unstable in the vicinity of the low end of the valve element 60, the flow of the fuel is separated from the valve element 60. Therefore, the vibration of the valve element 60 is reduced.

FIG. 5 shows data on experiment. In the conventional case, as shown by black triangles and black squares, as the amount of deviation of the axis of the valve element 60 from the axis of the valve seat 52 becomes larger, the drop in the control pressure at low flow rates becomes larger. Meanwhile, in this embodiment, as the amount of deviation of the axis of the valve element 60 from the axis of the vale seat 52 becomes smaller, the drop in the control pressure at low flow rates becomes smaller.

Also, even when the valve element 60 is moved downward with the axis of the valve element 60 matching the axis of the valve seat 52, the amount of the fuel flowing out through the opening portion on the right side of the valve element 60 does not become the same as the amount of the fuel flowing out through the opening portion on the left side of the valve element 60. Therefore, the valve element 60 is likely to vibrate. However, since the side wall surface of the concave portion 72 prevents the valve element 60 from vibrating to a predetermined extent, it is possible to prevent occurrence of abnormal noise.

Figure 6:
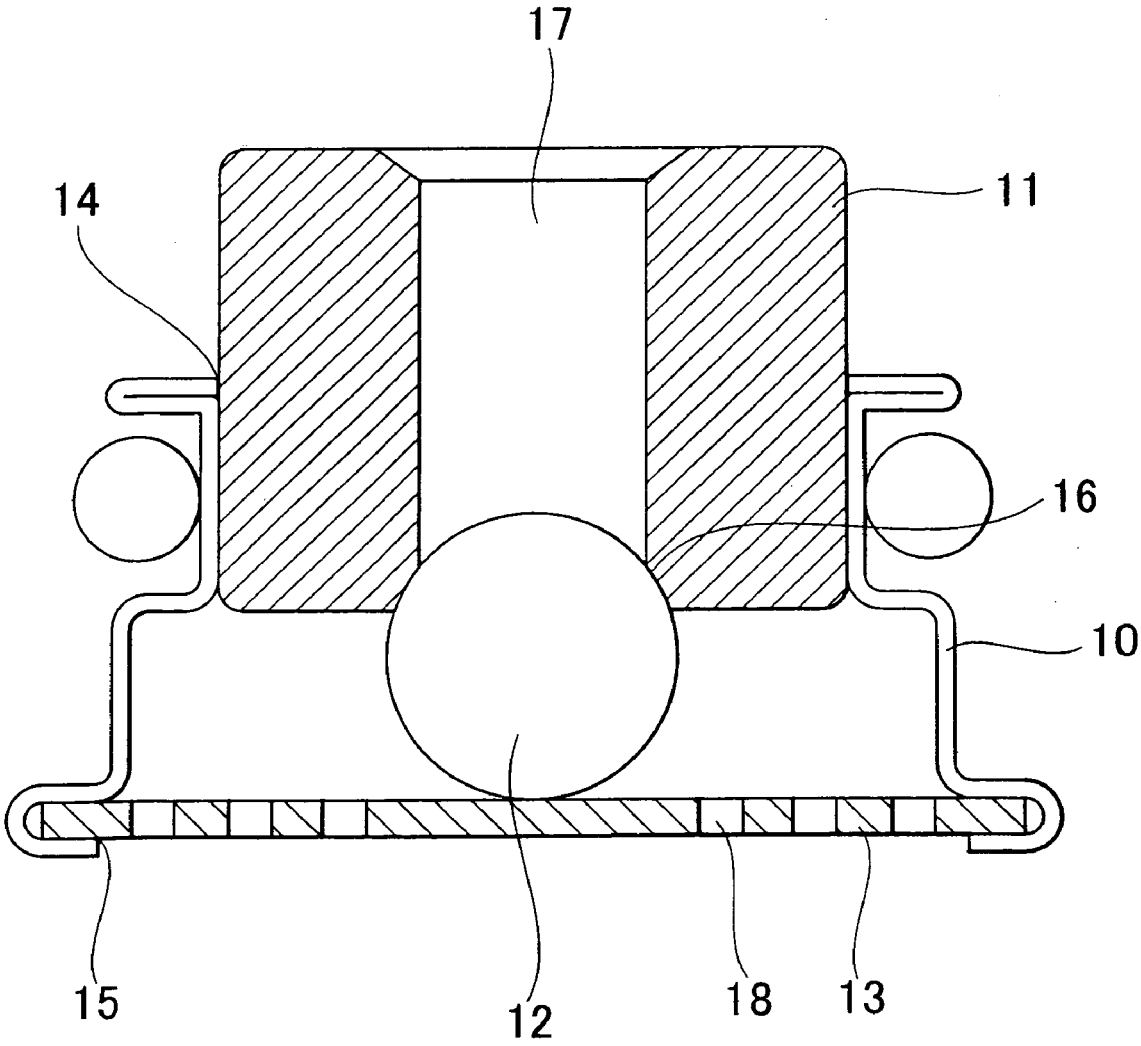
FIG.6 RELATED ART
FIG. 6 is a cross sectional view showing a fuel pressure adjusting apparatus according to art related to the invention.
Figure 7:
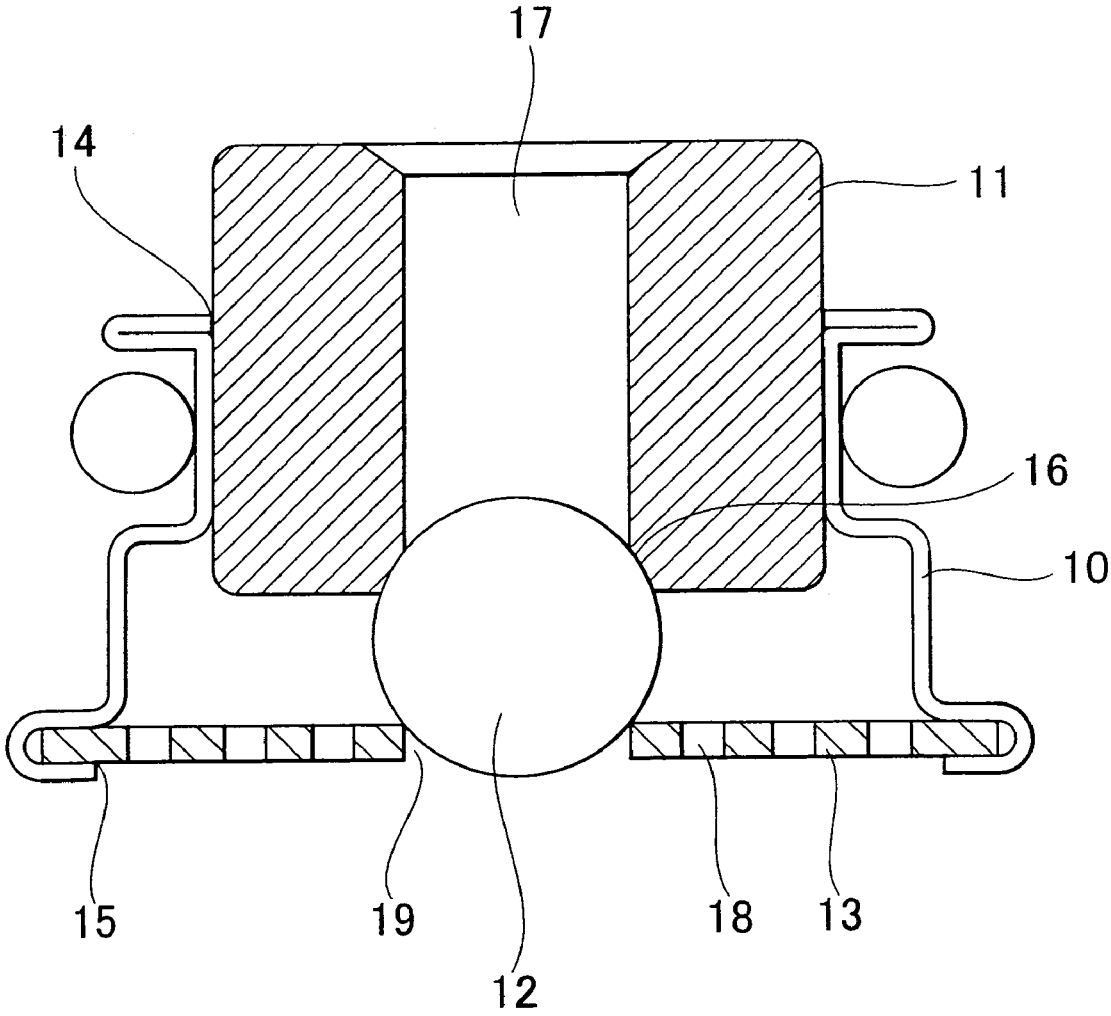
FIG.7 RELATED ART
FIG. 7 is a schematic cross sectional view showing another fuel pressure adjusting apparatus according to art related to the invention.
Figure 8:
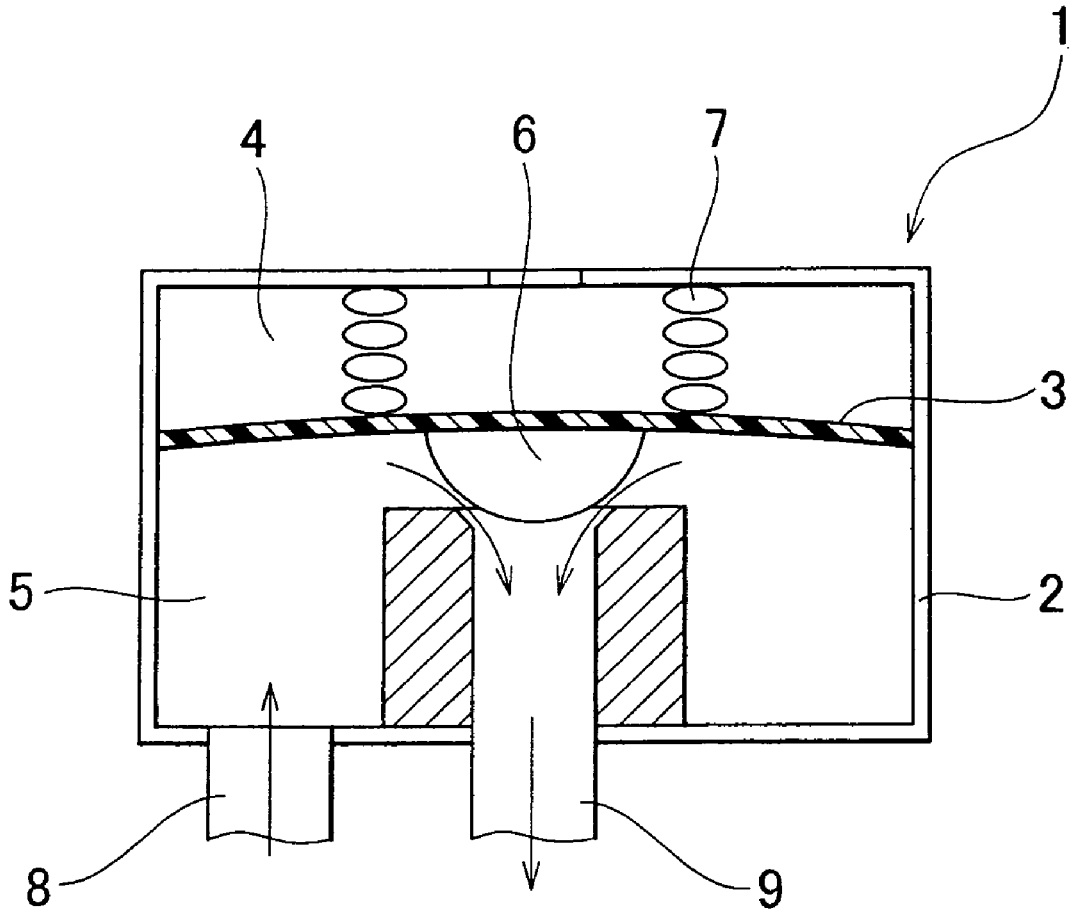
FIG. 8 RELATED ART
FIG. 8 is a cross sectional view showing a yet another fuel pressure adjusting apparatus according to art related to the invention.

In this embodiment, with the aforementioned configuration, it is possible to overcome the disadvantages in the art related to the invention shown in FIG. 6 and FIG. 7. In addition, it is possible to obtain the advantageous effect of the fuel pressure adjusting apparatus shown in FIG. 6 and the advantageous effect of the fuel pressure adjusting apparatus shown in FIG. 7 at the same time. The invention is not limited to the aforementioned embodiment, and design can be appropriately changed within the spirit and scope of the invention.

What is claimed is:

1. A fuel pressure adjusting apparatus comprising:

a casing which includes a fuel introduction port, and a fuel discharge port;

a cylindrical member which is housed in the casing, and which includes a valve seat at an end portion thereof, and a communication passage therein, the communication passage connecting the fuel introduction port to the fuel discharge port;

a valve element which is provided on a fuel discharge port-side of the cylindrical member in the casing, and which closes the communication passage when the valve element is seated on the valve seat; and a force-applying member which is provided at the fuel discharge port of the casing, and which applies force to the valve element in a direction toward the valve seat, wherein the force-applying member includes a concave portion which supports the valve element, the concave portion includes a bottom surface and a slanted annular side wall surface, and is formed such that there is a gap between the side wall surface and the valve element.

2. The apparatus according to claim 1, wherein the valve element is a spherical body.

3. The apparatus according to claim 2, wherein a depth of the concave portion is equal to or smaller than a half of a diameter of the valve element.

4. The apparatus according to claim 1, wherein the force-applying member is a leaf spring having a flat plate shape, and an outer edge portion of the force-applying member is fixed to the casing.

5. The apparatus according to claim 1, wherein the force-applying member includes a communication port.

6. The apparatus according to claim 1, wherein the force-applying member is joined to the casing by crimping.

7. The apparatus according to claim 1, wherein an area of an opening portion of the concave portion is larger than a cross sectional area of the valve element taken at the opening portion.

8. The apparatus according to claim 1, wherein the fuel introduction port of the casing is connected to a fuel passage that connects a fuel tank to an internal combustion engine, and the fuel discharge port of the casing is connected to the fuel tank.

9. The apparatus according to claim 1, wherein the force-applying member has a circular shape.

10. The apparatus according to claim 9, wherein the concave portion is formed at the center of the circular force-applying member.

11. A fuel pressure adjusting apparatus comprising:

a casing which includes a fuel introduction port, and a fuel discharge port;

a cylindrical member which is housed in the casing, and which includes a valve seat at an end portion thereof, and a communication passage therein, the communication passage connecting the fuel introduction port to the fuel discharge port;

a valve element which is provided on a fuel discharge port-side of the cylindrical member in the casing, and which closes the communication passage when the valve element is seated on the valve seat; and force-applying means which is provided at the fuel discharge port of the casing, and which applies force to the valve element in a direction toward the valve seat, wherein the force-applying means includes a concave portion which supports the valve element, which includes a bottom surface and a slanted annular side wall surface, and which is formed such that there is a gap between the side wall surface and the valve element.

* * * * *